US005680955A

United States Patent [19]

Schutz

[11] Patent Number: 5,680,955

[45] Date of Patent: Oct. 28, 1997

[54] PALLET CONTAINER

[75] Inventor: Udo Schutz, Selters, Germany

[73] Assignee: Protechna S.A., Fribourg/Schweiz, Switzerland

[21] Appl. No.: 710,952

[22] Filed: Sep. 24, 1996

[30] Foreign Application Priority Data

Sep. 26, 1995 [DE] Germany ..... 195 35 707.8

[51] Int. Cl.[6] ..... B65D 19/00

[52] U.S. Cl. ..... 220/401; 220/1.5; 220/403; 220/404

[58] Field of Search ..... 220/403, 400, 220/401, 404, 470, 4.21, 257, 663, 684, 1.5

[56] References Cited

U.S. PATENT DOCUMENTS

| | | | |
|---|---|---|---|
| 2,338,604 | 1/1944 | Silveyra | 220/404 X |
| 2,939,603 | 6/1960 | Young | 220/4.21 |
| 3,081,911 | 3/1963 | Scholle . | |
| 3,167,210 | 1/1965 | Carney, Jr. | 220/404 X |
| 3,272,373 | 9/1966 | Alleaume et al. | 220/470 X |
| 3,443,601 | 5/1969 | Siegwart | 220/684 X |
| 3,918,605 | 11/1975 | Butler | 220/404 |
| 4,838,443 | 6/1989 | Cripe et al. | 220/663 X |
| 4,947,988 | 8/1990 | Schutz | 220/401 X |
| 5,002,194 | 3/1991 | Nichols | 220/1.5 |
| 5,046,634 | 9/1991 | McFarlin et al. | 220/404 X |
| 5,110,000 | 5/1992 | Nichols | 220/1.5 X |
| 5,320,237 | 6/1994 | Stolzman | 220/257 |
| 5,447,250 | 9/1995 | Schutz | 220/403 |

FOREIGN PATENT DOCUMENTS

| | | |
|---|---|---|
| 27 57 674 | 6/1978 | Germany . |
| 40 07 617 | 9/1991 | Germany . |
| 91 14 660.7 | 3/1992 | Germany . |
| 41 08 399 | 10/1992 | Germany . |
| 93 10 375.1 | 10/1993 | Germany . |

*Primary Examiner*—Steven M. Pollard
*Attorney, Agent, or Firm*—Young & Thompson

[57] ABSTRACT

A pallet container (1) which may be used as a one-way of multi-way container to transport and store fluids, includes a blow molded fluid container (2) made of plastic which has a drain bottom (3) and a flexible inner liner (4) made of plastic foil or a composite metal-plastic foil. A pallet (5) which is designed as a floor pan (6) made of sheet metal or plastic which has a drain bottom (7) designed to serve as a form-fitted receptacle for the fluid container (2), as well as a metal grid casing (8) or sheet metal casing which encloses the fluid container (2). The fluid container (2) is sealed with a removable closure (12) which allows a simple and fast insertion of the inner liner (4) in the fluid container (2). To facilitate the insertion and removal of the inner liner into and/or from the fluid container, the same may be equipped with an integrally molded hinged cover, and it is possible to divide the fluid container into two halves after the blow molding.

22 Claims, 17 Drawing Sheets

PALLET CONTAINER

Figure 1:
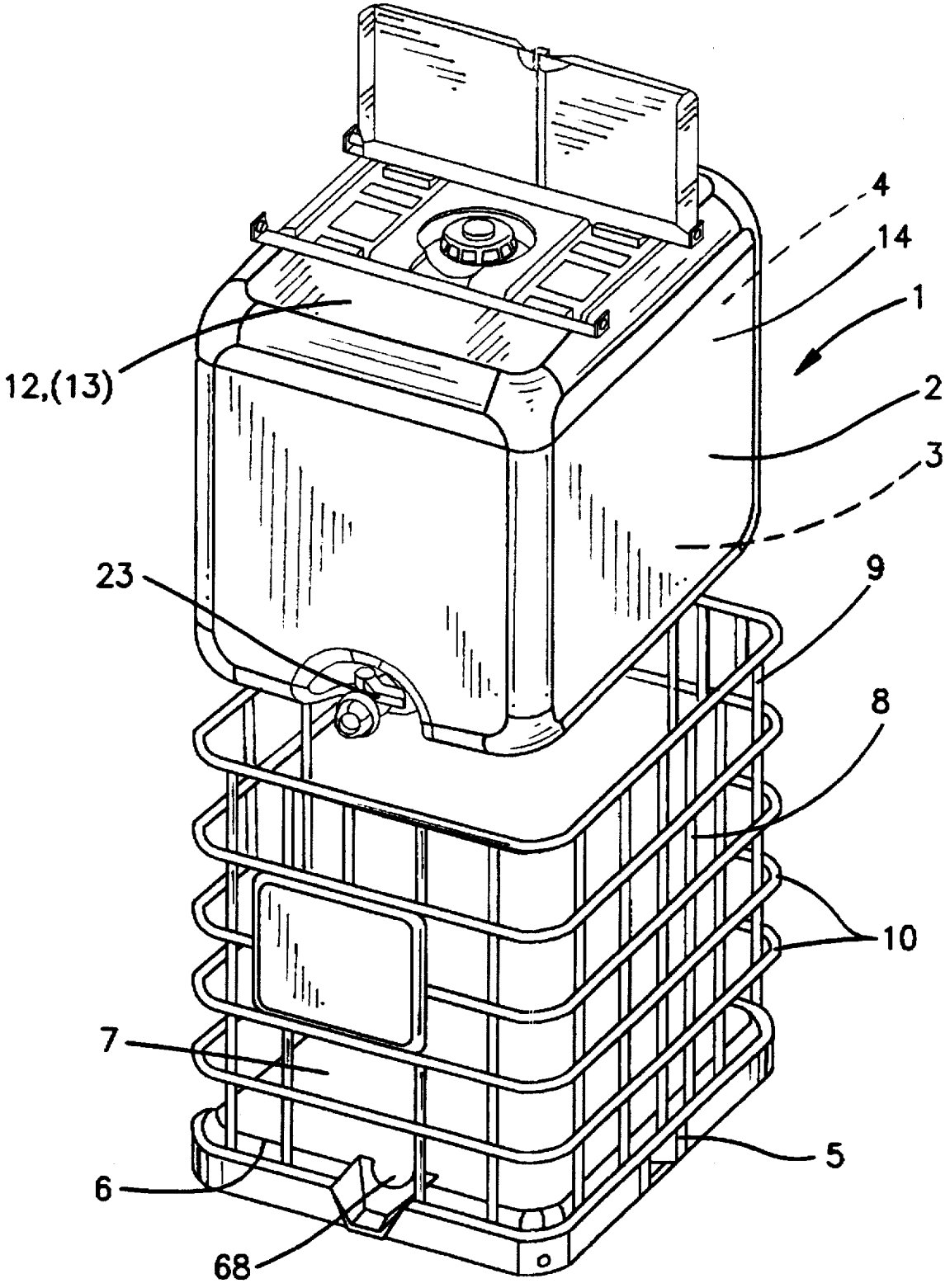

This invention relates to a pallet container which consists era cube-shaped, blow molded fluid container, made of plastic which has one sealable opening each for filling and emptying, a drain bottom, a flexible inner liner made of plastic foil or a composite metal-plastic foil, a pallet which is designed as floor pan made of sheet metal or plastic which has a drain bottom designed to serve as a form-fitted receptacle for the fluid container, as well as an outer shell which abuts the fluid container and which is constructed as a grid casing made of metal rods or as a sheet metal casing. (DE 41 08 399 C1).

The pallet containers according to the field of art used primarily in the food industry, are particularly suited to be used as multi-way containers which can be reconditioned cost effectively while not polluting the environment with toxic substances, by allowing a complete emptying of the fluid and a nontoxid disposal of the inner liner, e.g., by incineration, and a simple cleaning.

In the conventional pallet container the insertion of the inner liner into the interior of the fluid container through the filler neck is cumbersome and time consuming. Another disadvantage is the fact that the inner liner which features a short filler tube whose opening rim is wrapped outwardly over the opening rim of the filler neck of the fluid container, and clamped onto the filler neck by the lid of the same, may tear during transport under the influence of the surge forces of the fluid located in the liner in the area of the filler tube.

The pallet container according to this invention is characterized by the following advantages:

The construction of the fluid container, blow molded from plastic with an integrally molded hinged cover, and the two-part design of the container permit a simple insertion of the inner liner into and removal from the container. The dimensionally stable, flexible upper part of the inner liner into which the filler neck is integrally molded, prevents the inner liner from tearing in the area of the filler neck which is particularly vulnerable during transport due to the influence of the fluid's surge forces, and it ensures a snug fit of the inner liner onto the interior wall of the fluid container.

In the following the invention is described by exemplified embodiments illustrated in a drawing. It shows FIG. 1 an exploded view of a pallet container with a fluid container with an inner liner and a removable lid, FIG. 2 a perspective view of the fluid container of the pallet container according to FIG. 1, FIG. 3 a detail according to section III of FIG. 2, FIG. 4 a longitudinal section through the filling area of the pallet container according to FIG. 1 in an enlarged view, FIGS. 5 enlarged fragmentary sections of various and 6 removable closures for the fluid container of the pallet container according to FIG. 1, FIGS. 7 enlarged fragmentary sections of fluid containers to 9 with an opening rim pulled up to the upper edge of the outer grid casing and with various embodiments of removable closures, FIG. 10. a perspective view of a fluid container with another embodiment of a removable closure, FIG. 11. a section through the area of the opening rim of the fluid container according to FIG. 10 in an enlarged view, FIG. 12. a perspective view of a fluid container with an integrally molded hinged cover, FIG. 13. a section through the area of the opening rim of the fluid container according to FIG. 12 in an enlarged view, FIGS. 14*a* various types of sections of a blow molded fluid container in two halves to 14*f*

Figure 15:
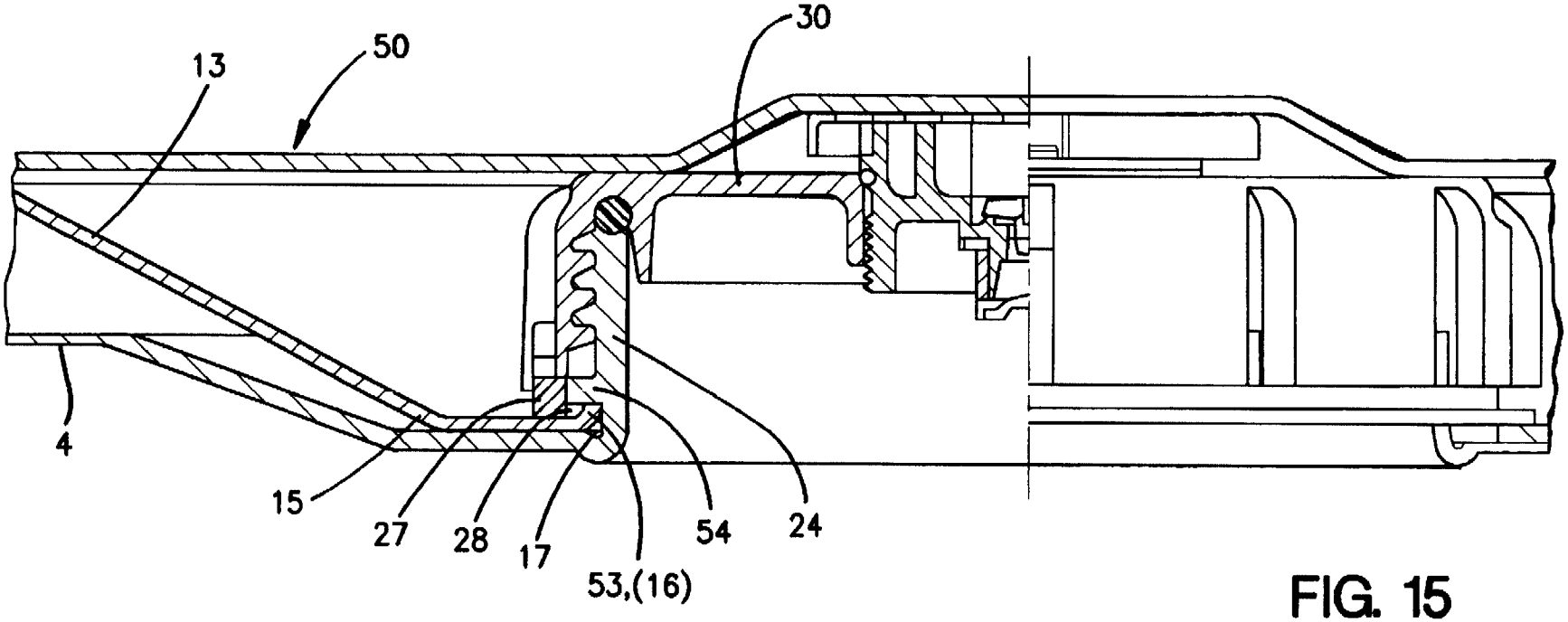
Figure 16:
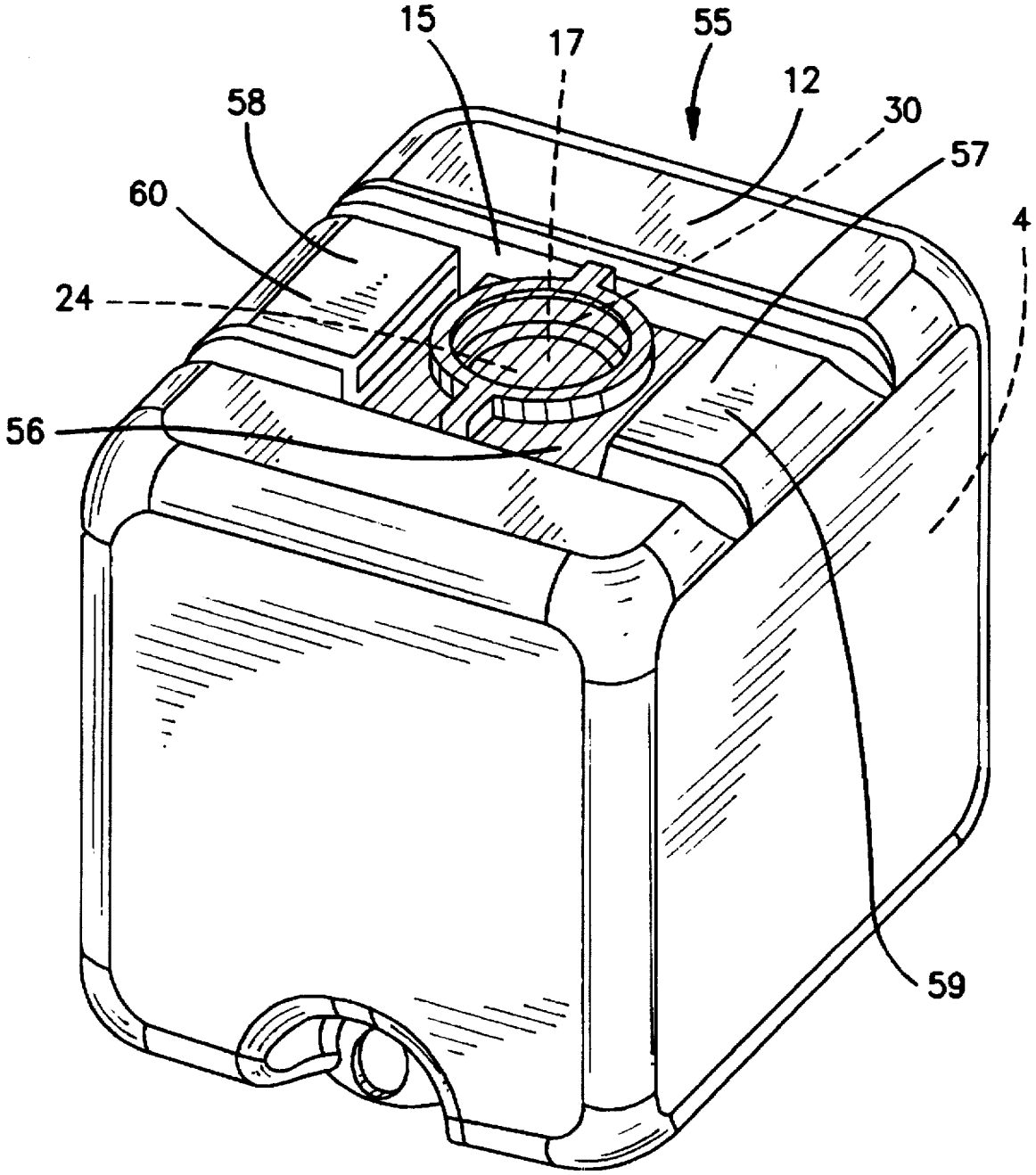

FIG. 15 an enlarged longitudinal section trough the opening area of a fluid container which has been bisected through the center of the opening in the upper wall to accommodate the filler neck FIG. 16 the perspective view of a fluid container with a splash guard for the closure of the filler neck and two document holders located beneath protective covers.

Figure 17:
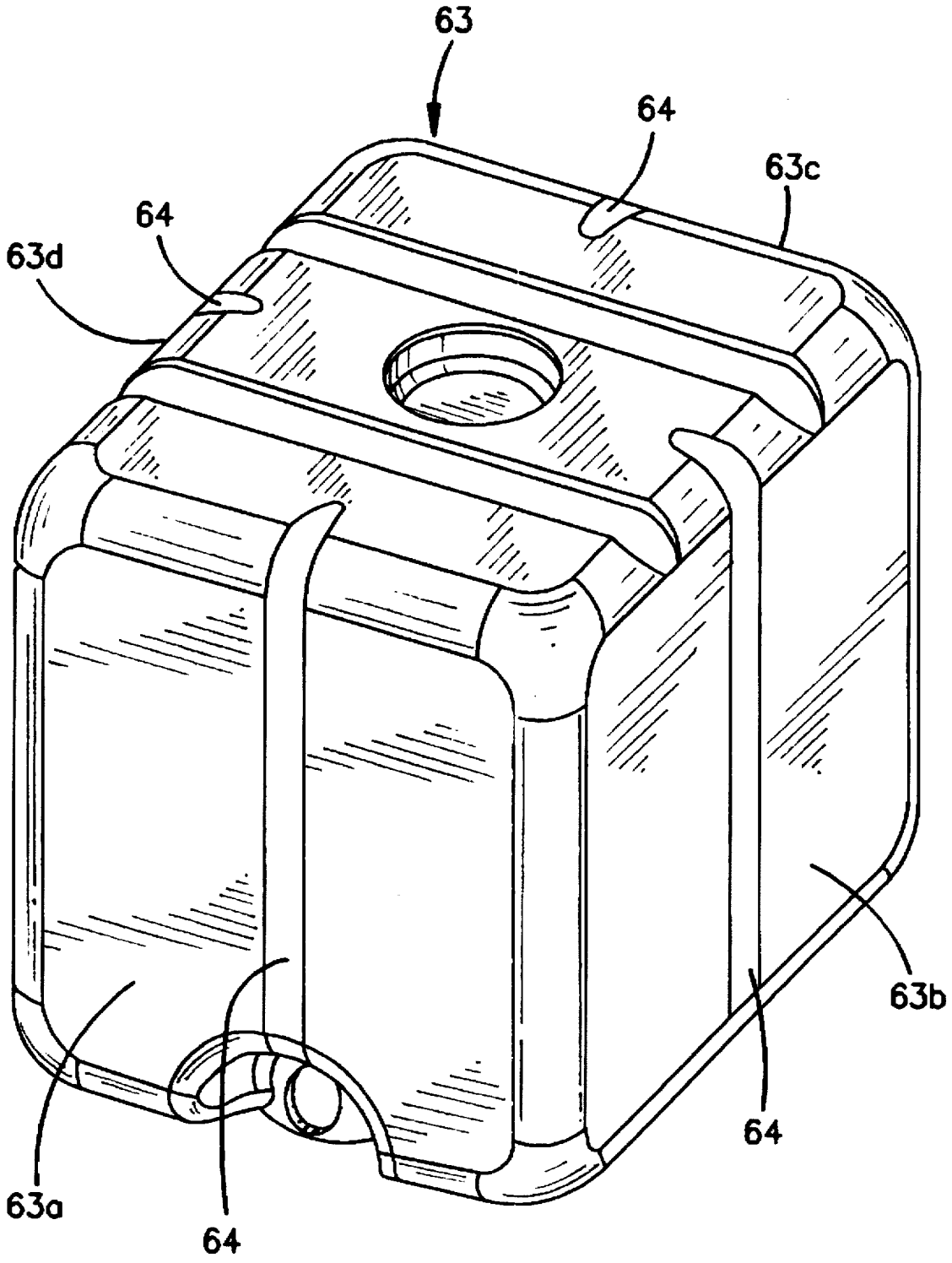
Figure 19:
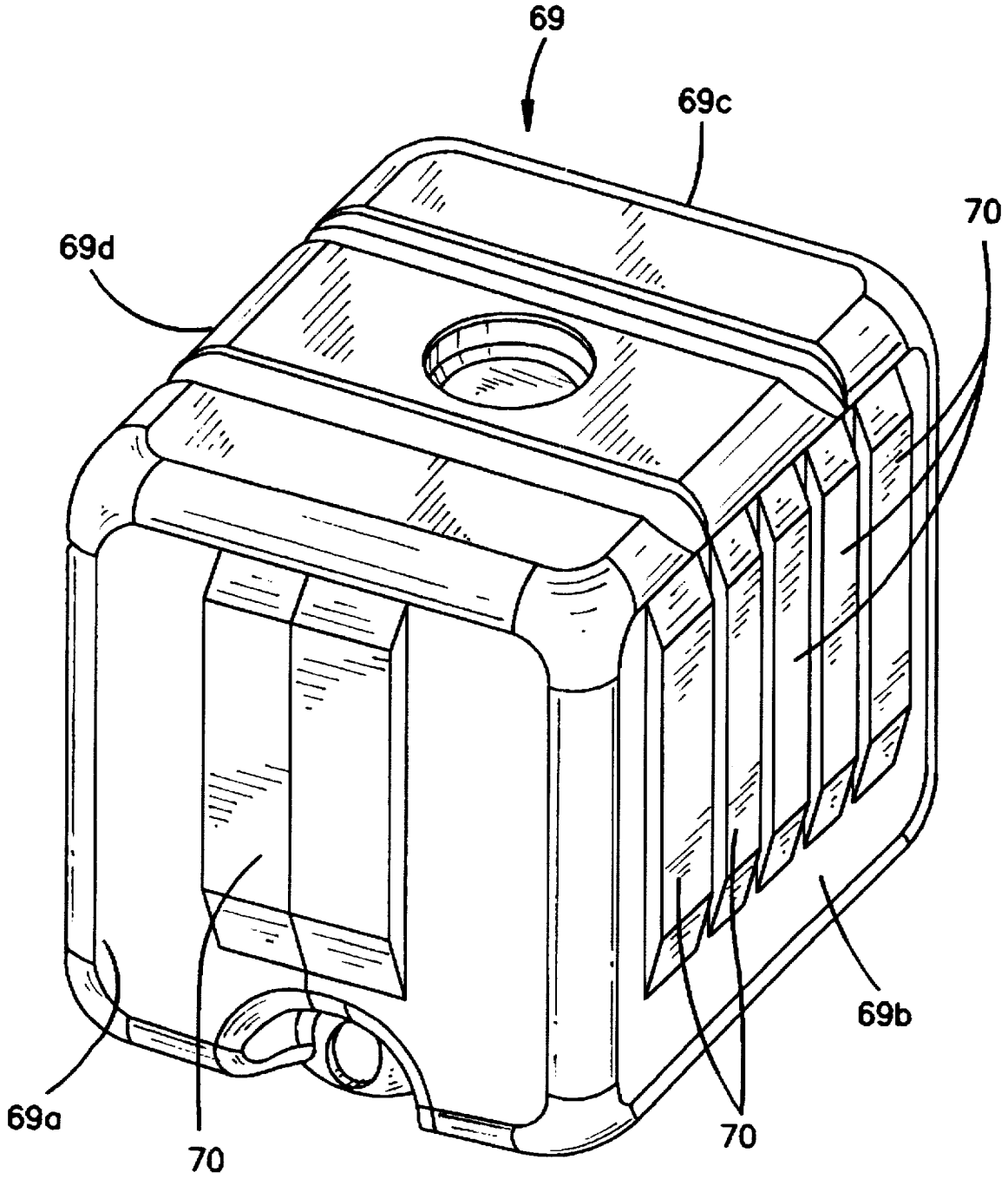

FIGS. 17 perspective views of a fluid containers with fluid level indicator strips arranged and 18 in different ways on the lateral container walls, FIG. 19 the perspective view of a fluid container with writing surfaces integrated into the container walls.

The pallet container 1 according to FIG. 1, which may be used as a one-way or multi-way container to transport and store fluids, features as main component parts a cube-shaped, blow molded fluid container 2 made of plastic which is equipped with a drain bottom 3 and a flexible inner liner 4 made of plastic foil or a composite metal-plastic foil, a pallet 5, which is constructed as a floor pan 6 made of sheet metal or plastic with a drain bottom 7, and which serves as a form-fitted receptacle for the fluid container 2, as well as an outer casing 8 which abuts the fluid container 2 and which is made of metal rods 9, 10 which cross each other vertically and horizontally.

Figure 2:
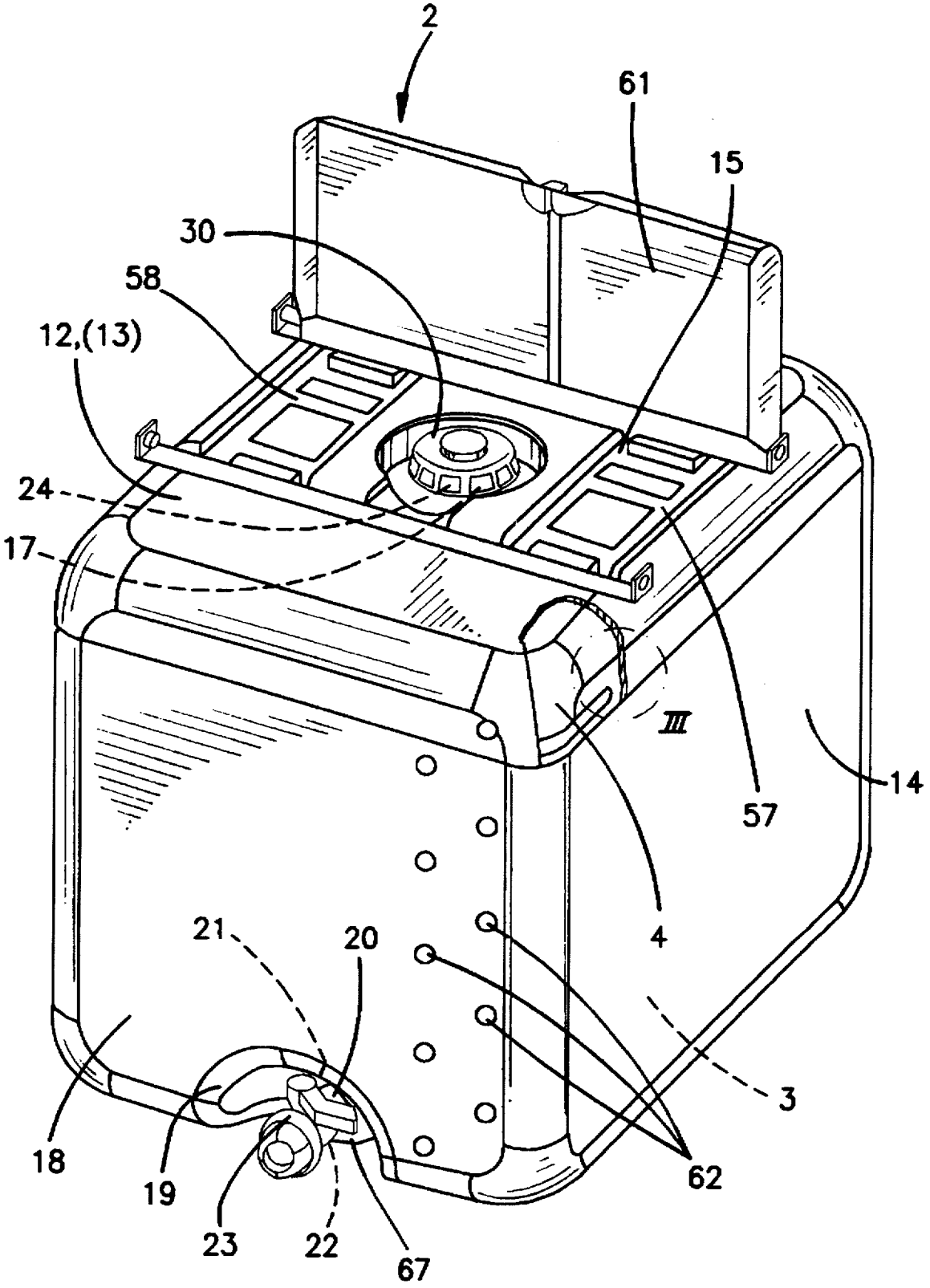
Figure 3:
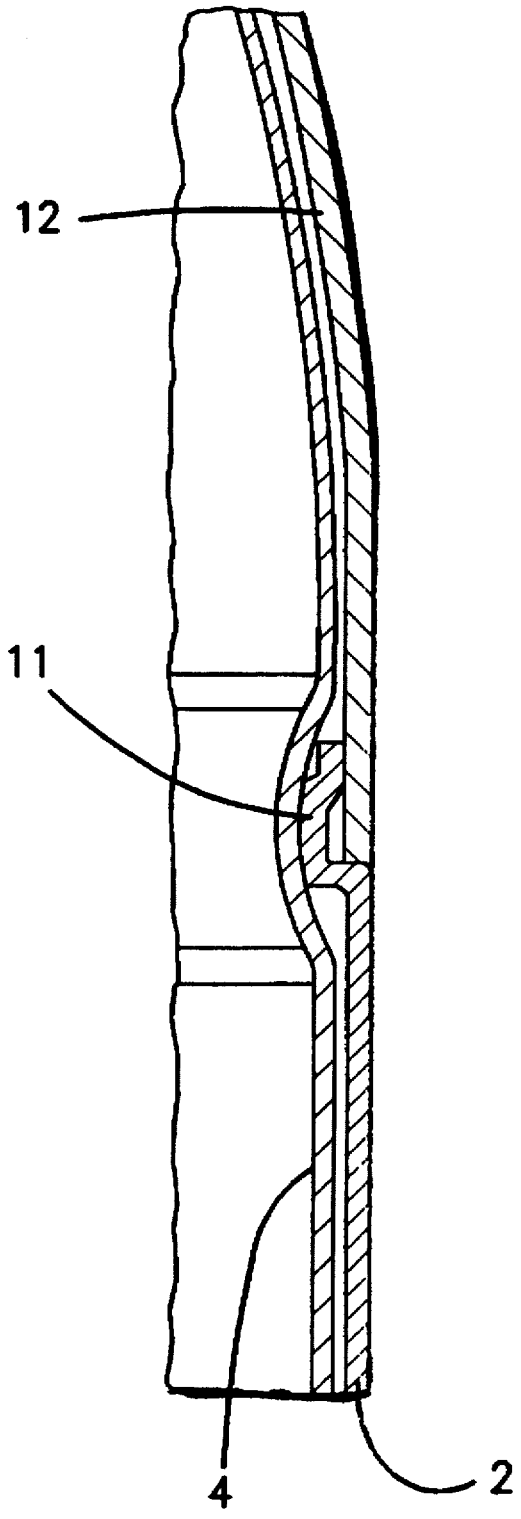

The fluid container 2 as shown in FIGS. 2 and 3 is sealed with a removable closure 12 which is positioned on top of the opening rim 11 of the container. The closure 12 is obtained by separating the upper wall 13 from the shell 14 of the blow molded container 2.

The upper wall 13 of the fluid container 2 is blow molded with a centered transverse channel 15 onto which a centric short feed pipe is integrally molded which is cut or punched open before or after separating the upper wall 13 from the container shell 14, so as to give the closure 12 a centric circular opening 17 (FIGS. 2 and 15).

Figure 4:
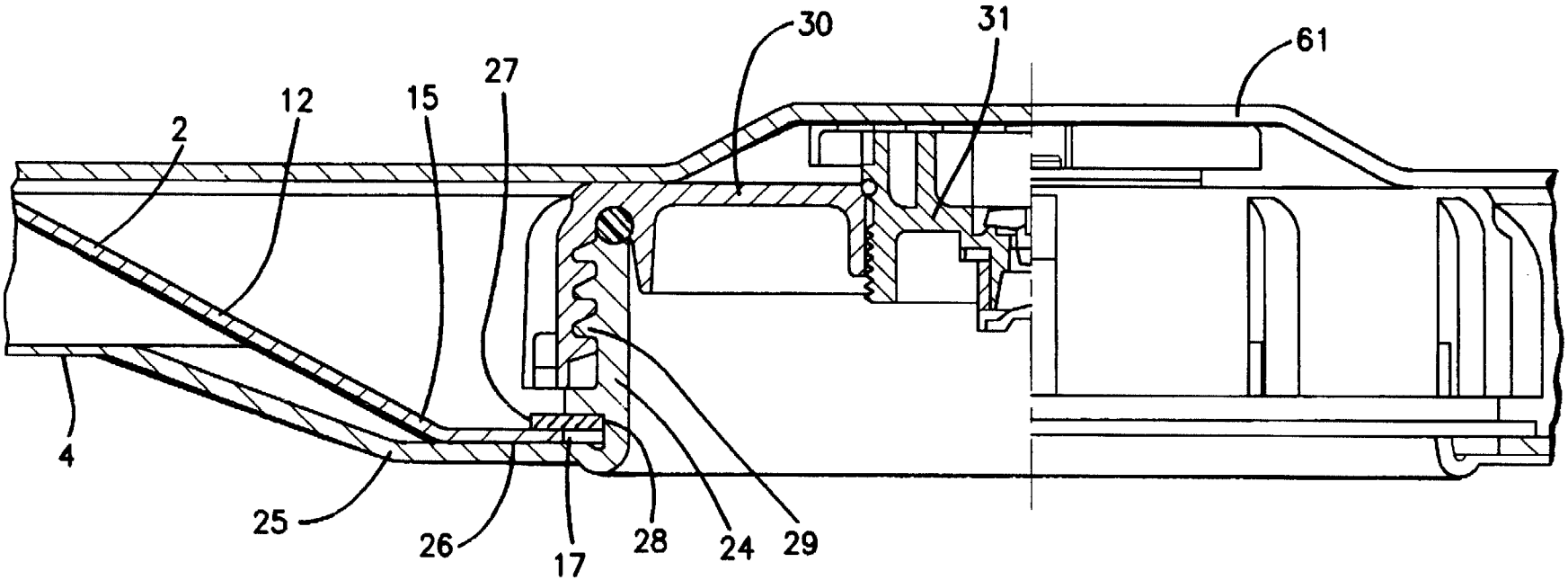

It is also possible to construct the container 2 without the filler neck in the channel 15, and to cut the opening 17 from the channel 15 (FIG. 4).

The lower part of the middle section of the front wall 18 of the fluid container 2 forms an arched recess 19 which is a hood-shaped injection molded plastic part with a short filler neck 20 integrally molded into the container 2. The filler neck 20 is cut open at the arched recess 19 the blow molded container 2 giving the same a bottom opening 21. Beneath the bottom opening 21 an outlet shield 67 is molded into the arched recess 19 covering the area 68 of the sheet metal floor pan 6 underneath the drain cock 23 (FIGS. 1 and 2).

When inserting the inner liner 4 into the fluid container 2, the drain nozzle 22 which is either blow molded into the liner or welded onto the same later, and which has an outside screw thread, is first pushed from the inside through the bottom opening 21 in the container front wall 18; then a drain cock 23 is screwed onto the drain nozzle 22 which protrudes from the container 2 (FIG. 2). Now the filler neck 24 of the inner liner 2 which is integrally molded into an dimensionally stable upper part 25 which may be integrally molded or welded onto the liner 4, is pushed from the inside through the central opening 17 of the closure 12 which has been slightly lifted from the opening rim 11 of the fluid container 2, causing the upper part 25 of the liner 4 to butt against the interior wall 26 of the closure 12. The filler neck 24 of the inner liner 4 is held securely in the opening 17 of the closure 12 by means of a notched clamp collar 27 which is slipped over from above and which locks into an undercut 28 of the filler neck 24 (FIG. 4).

The filler neck 24 which has an outside screw thread 29 and which is located at the inner liner 4 of pallet container 1 is sealed with a screw cap 30 which features an integrated relief pressure valve 31.

Figure 5:
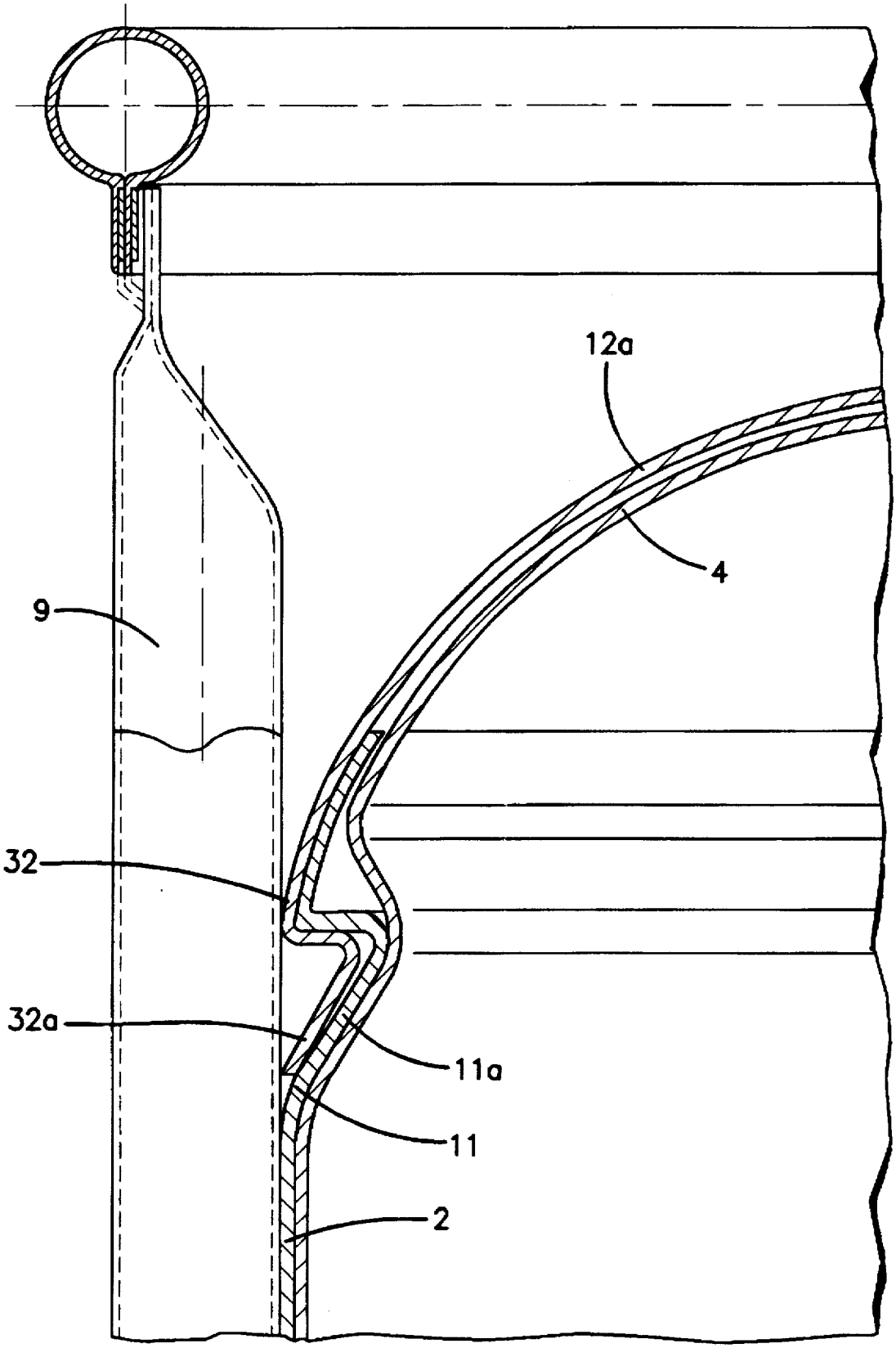
Figure 6:
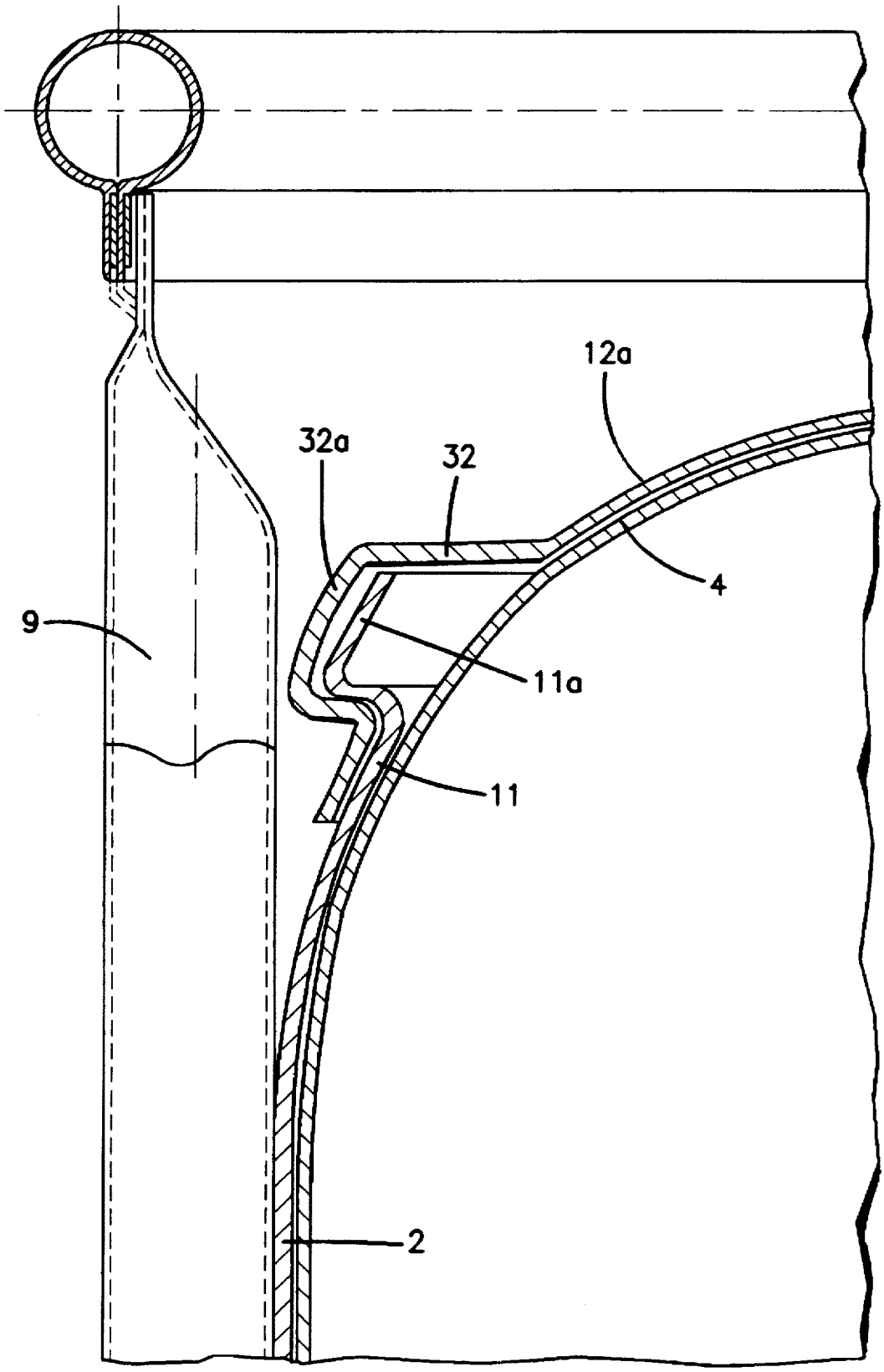

FIGS. 5 and 6 show two embodiments 12*a*, 12*b* of a removable clamp lid having a clamp rim 32 to clamp the lids 12*a*, 12*b* onto the opening rim 11 of the fluid container 2 which features a corresponding counter-profile 11*a* to the clamp profile 32*a* of the cover rim 32.

Figure 7:
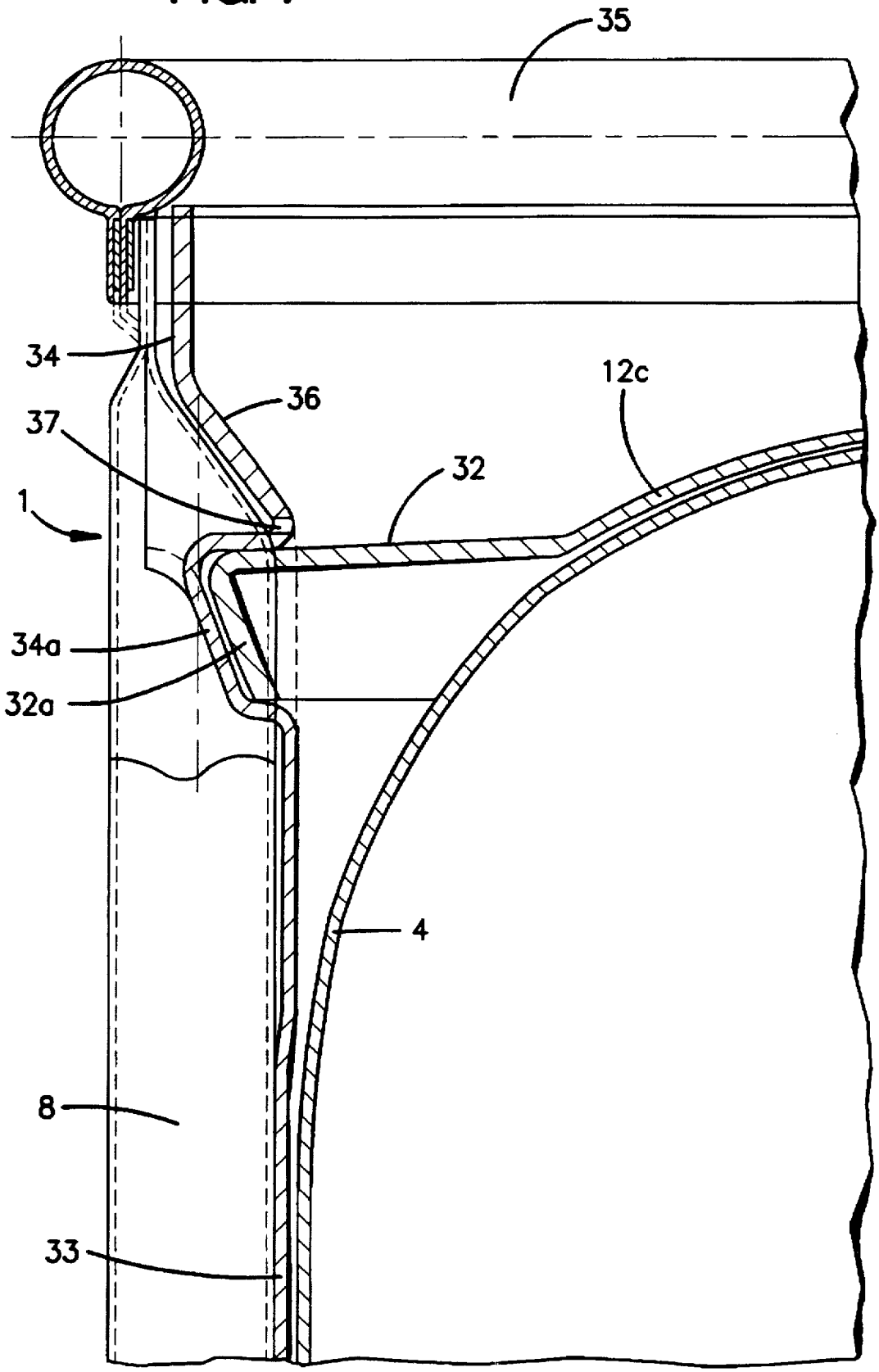
Figure 8:
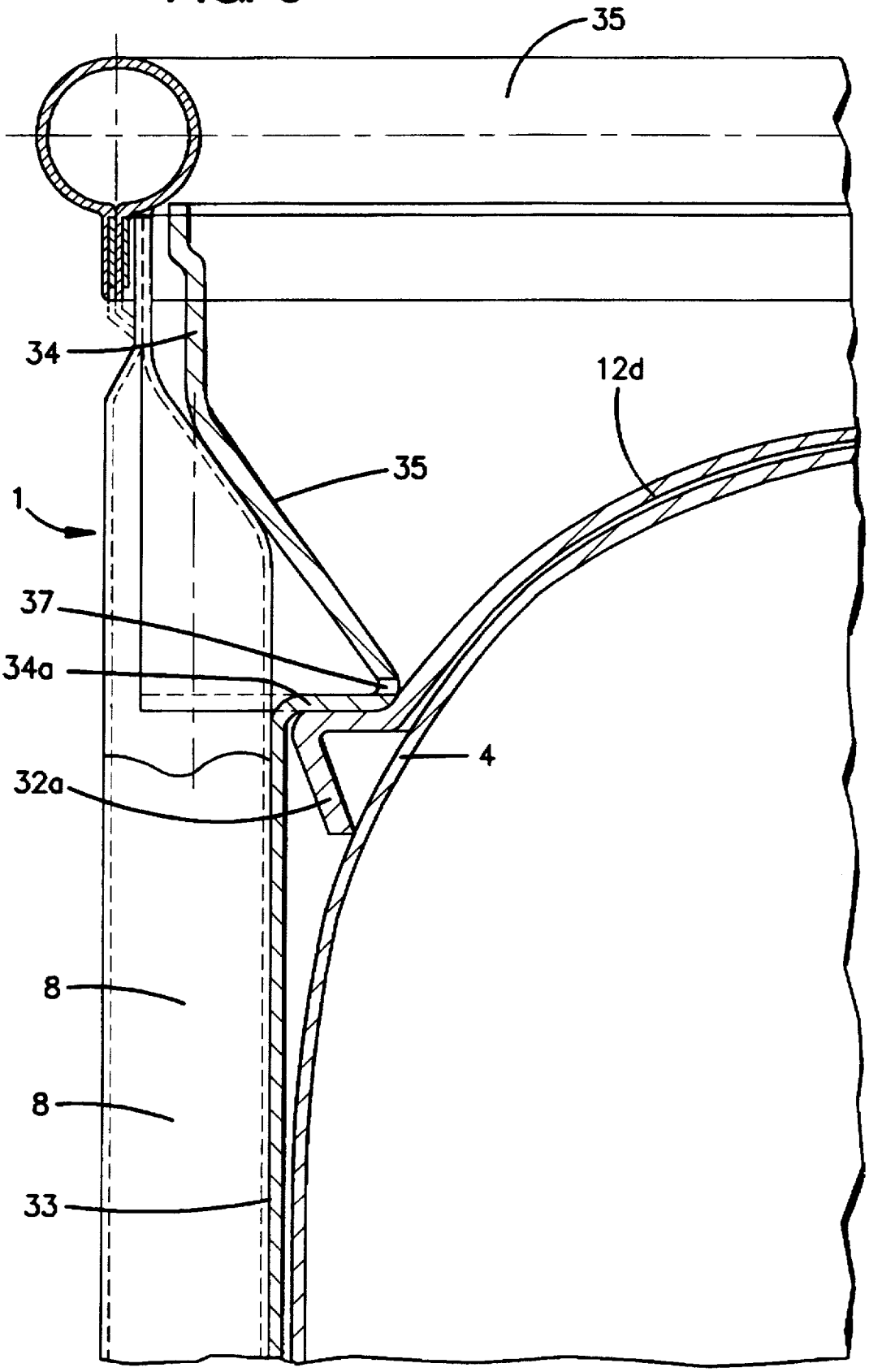
Figure 9:
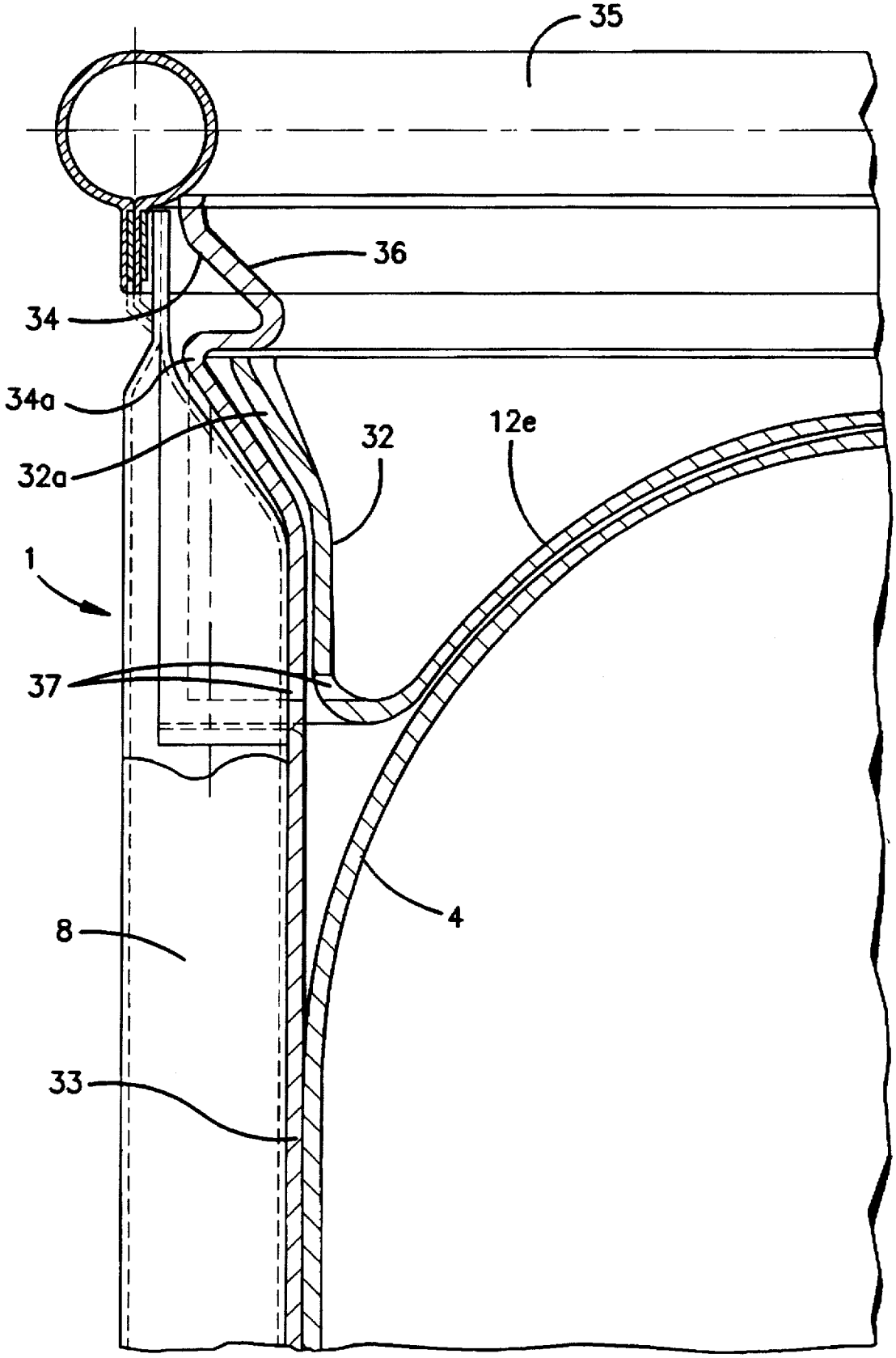

FIGS. 7 to 9 illustrate fluid containers 33 whose opening rim 34 is pulled up to the upper edge 35 of the grid casing 8 of the pallet container 1 and over the container closure 12*c*–12*e*. The various container closures 12*c*–12*e* designed as clamp lids have a clamp rim 32 with a clamp profile 32*a* by means of which the closures 12*c*–12*e* are fastened to the inside 36 of the opening rim 34 of the containers 33 and which features a corresponding counter profile 34*a* to the clamp profile 32*a* of the cover rim 32.

The fluid containers 33 with the closure embodiments 12*c*, 12*d*, shown in FIGS. 7 and 8, feature water drain holes 37 in the raised opening rim 34; in container 33 with closure 12*e* as shown in FIG. 9 drain holes 37 are featured in the opening rim 34 of the fluid container 33 and in the clamp rim 32 of the closure 12*e*.

Figure 10:
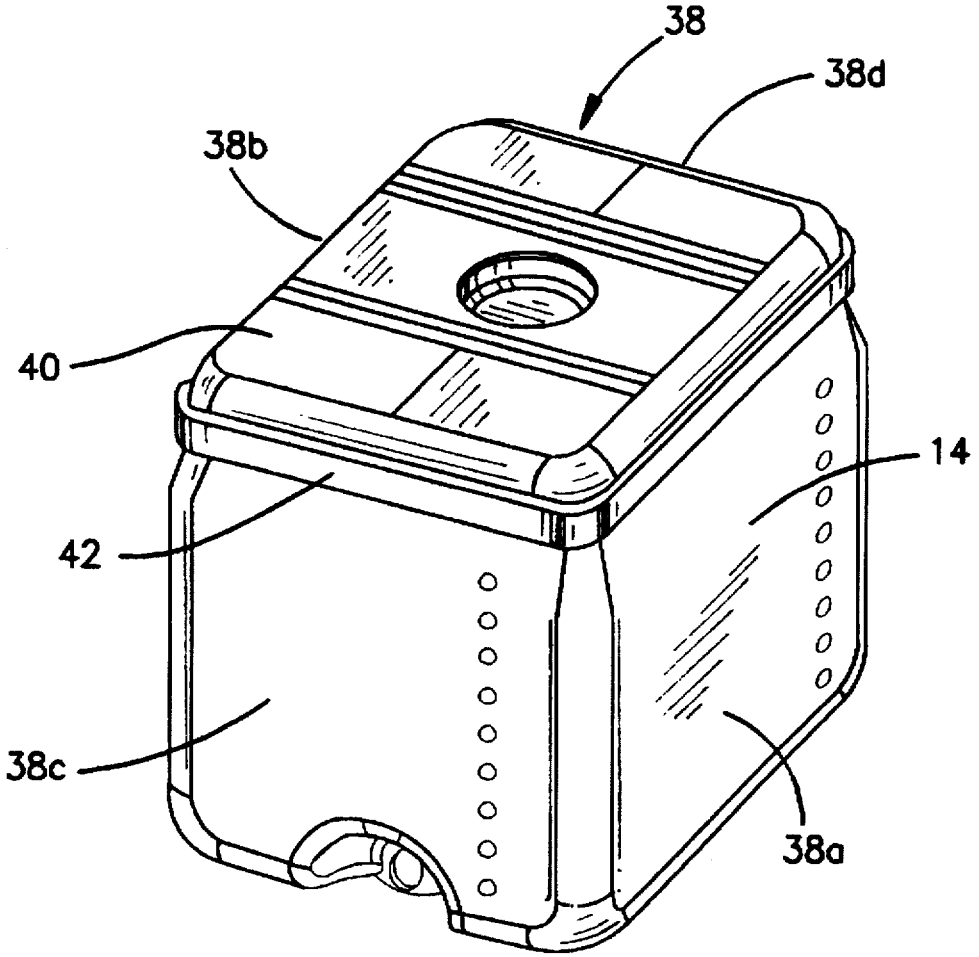
Figure 11:
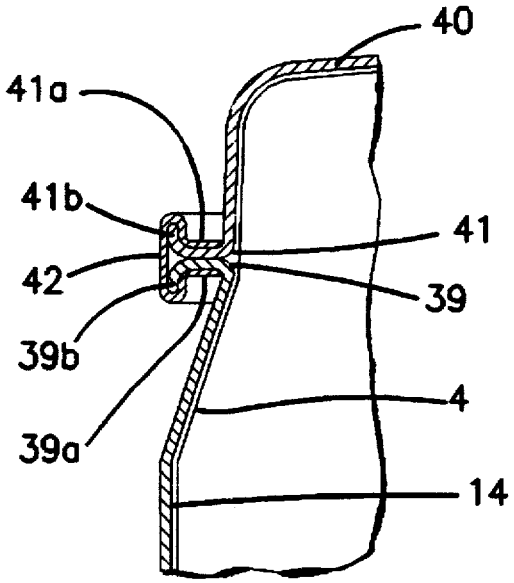

The shell 14 of the fluid container 38 shown in FIGS. 10 and 11 features an opening rim 39 with a horizontal rim section 39*a* and a perpendicular rim section 39*b* angled downward; and the removable lid 40 features a bottom rim 41 with a horizontal rim section 41*a* which has been fitted to conform to the horizontal opening rim section 39*a* and a perpendicular rim section 41*b* angled upward. The opening rim 39 of the container 38 and the cover rim 41 are clinched together by a profiled metal clamp collar 42 across the two lateral walls 38*a*, 38*b*, the front wall 38*c* and the back wall 38*d* of the fluid container 38.

Figure 12:
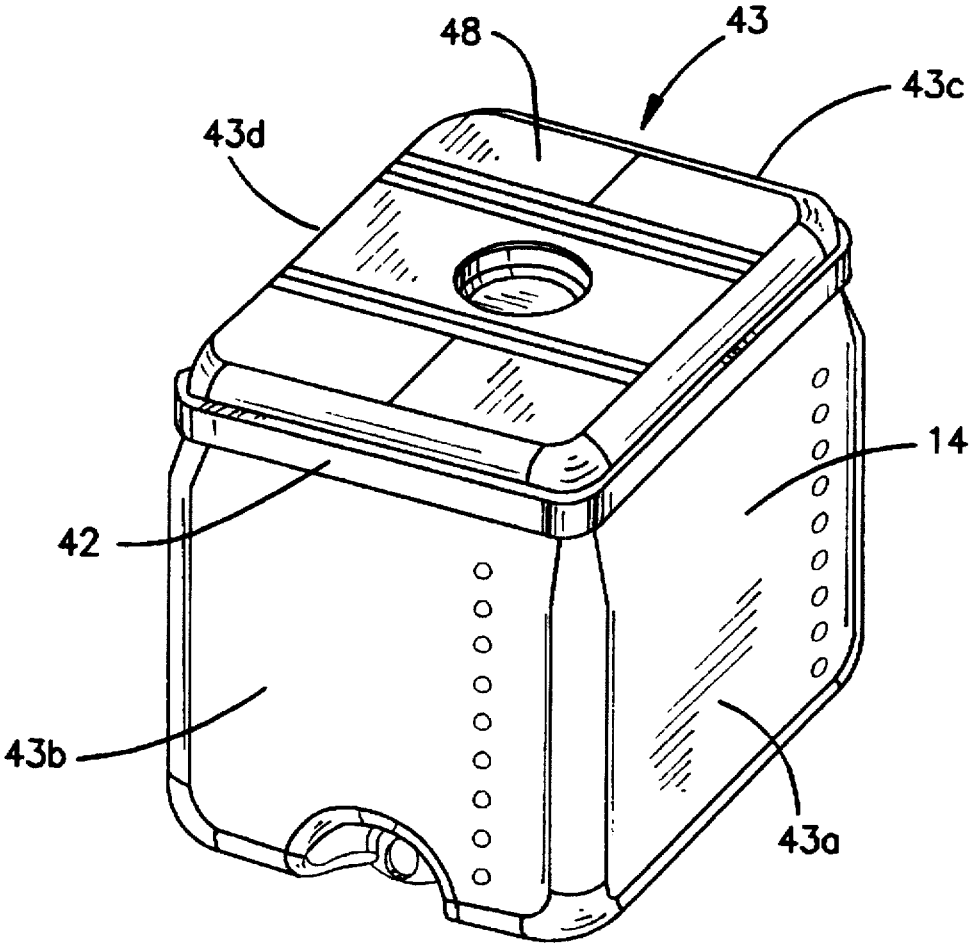
Figure 13:
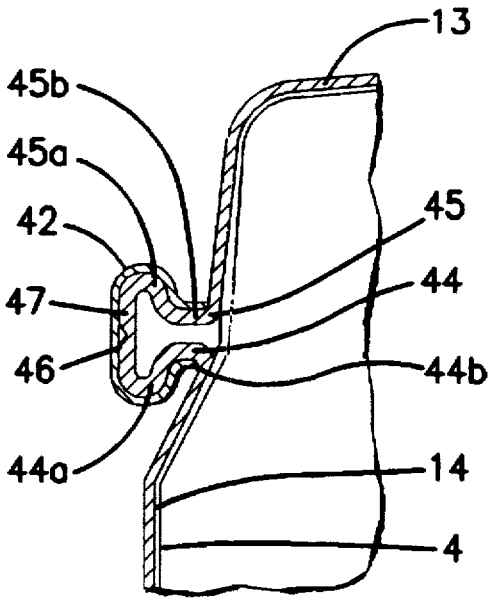

A downwardly pointing outer rim 44*a* has been integrally molded into the upper rim 44 of the shell 14 of the fluid container 43 shown in FIGS. 12 and 13 which was blow molded in one piece; and an upwardly pointing outer rim 45*a* has been integrally molded into the lower rim 45 of the upper wall 13 of container 43 leaving a space between the rim joints 44*b*, 45*b*. The two outer rims 44*b*, 45*b* are connected by a ring-shaped bridge 46 which is of a lesser gauge compared to the outer rims. The ring land 46 is cut open at one lateral wall 43*a*, at the front wall 43*b* and the back wall 43*c* of container 43, so that the upper wall 13 of container 43, by being connected by a film hinge to the lateral wall 43*d* of the container shell 14, forms a hinged cover 48. The hinged cover 48 of container 43 is sealed with a profiled metal ring 42.

Another possibility for a simplified insertion of the inner liner into the fluid container of the pallet container is found by dividing the blow formed fluid container into two halves; the bisection of the container may occur in different ways as illustrated by FIGS. 14*a* to 14*f*.

Figure 14A:
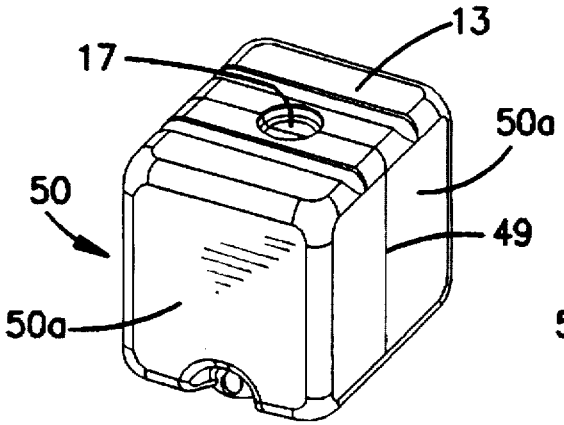

FIG. 14*a* shows a transverse sectioning 49 of a fluid container 50 across the central opening 17 in the upper wall 13 into two halves of equal size 50*a*, 50*a*.

Figure 14C:
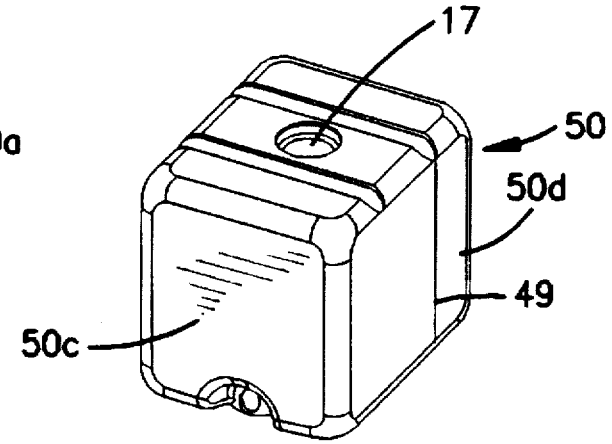
Figure 14B:
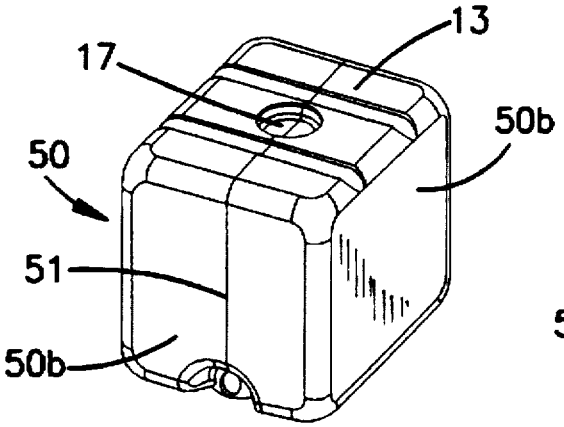

FIG. 14*b* illustrates a longitudinal sectioning 51 of fluid container 50 through the central opening 17 in the upper wall 13 into two halves of equal size 50*b*, 50*b*.

Figure 14D:
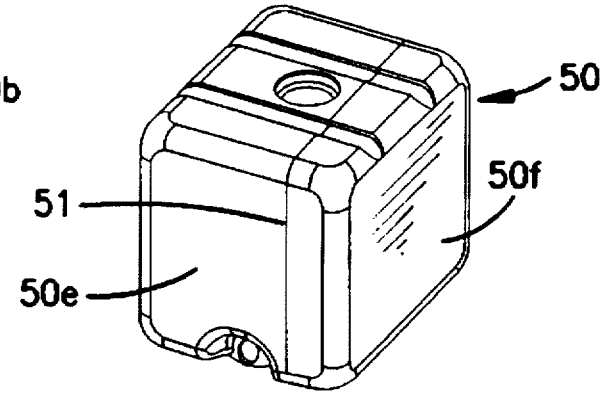

FIG. 14*c* illustrates the offset transverse sectioning 49 of fluid container 50 adjacent to the wall opening 17 into two halves of unequal size 50*c*, 50*d*; and FIG. 14*d* shows the offset longitudinal sectioning 51 of container 50 into two halves of unequal size 50*e*, 50*f*.

Figure 14E:
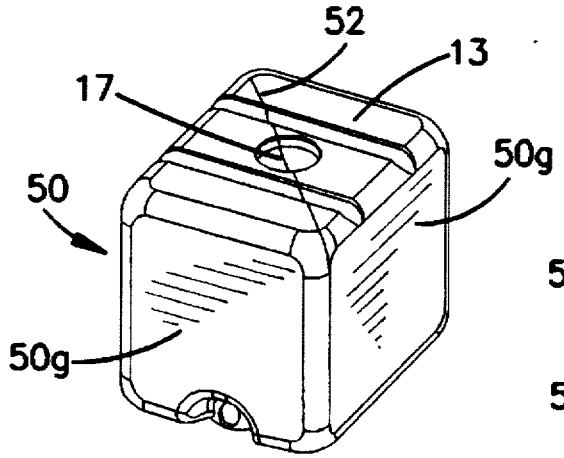
Figure 14F:
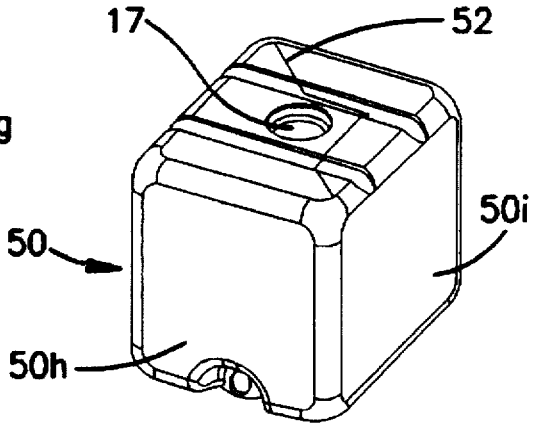

Finally FIG. 14*e* shows a diagonal sectioning 52 of the fluid container 50 through the central opening 17 in the upper wall 13 into two halves of equal size 50*g*; and FIG. 14*f* shows an offset diagonal sectioning 52 of container 50 adjacent to the opening 17 into two halves of unequal size 50*h*, 50*i*.

In the fluid container 50, shown in FIGS. 14*a*, 14*b* and 14*e*, which is divided transversely 49, longitudinally 51 and diagonally 52 through the central opening 17 in the upper wall 13 of the container into two halves of equal size, the rim 53 of opening 17 which is formed by cutting through the short filler neck 16 which is integrally molded into the center of the channel 15 of container 50, locks into the undercut 28 of the filler neck 24 of the inner liner 4 inserted into container 50. The filler neck 24 of the inner liner 4 is held in place in the opening 17 of the upper wall 13 of the fluid container 50 by a notched clamp collar 27 which is slipped over from above. The two halves 50*a* of fluid container 50 are being held together by the clamp collar 27, which surrounds the joint 54 formed by the undercut 28 of filler neck 24 of inner liner 4, and through which the cap 30 which is screwed onto the filler neck 24, is clamped to the channel 15 in the upper wall 13 (FIGS. 14 and 15).

In order to protect the screw cap 30 of the fluid container 55 as shown in FIG. 16 from contamination, it is covered by an adhesive foil 56 which simultaneously serves as original seal.

According to FIG. 16 two document holders 57, 58 covered by protective lids 59, 60, have been installed in the channel 15 of the closure 12 of the fluid container 55 on both sides of the opening 17 which is the receptacle for filler neck 24 of the inner liner 4.

In the fluid container 2 according to FIG. 2 a protective lid 61 has been integrated into the removable closure 12 for screw cap 30 of the filler neck 24 and the two document holders 57, 58.

In order to protect the various fluid containers 2, 33, 38, 43, 50 and 55 from uv-rays, they may be dyed in a dark color, preferably black.

According to FIG. 2 observation holes 62 have been installed in the front wall 18 of the fluid container in order to control the fluid level.

According to FIG. 17 the fluid container features four observation strips 64 made of transparent material which have been integrated into the lateral walls 63*a*–63*d* to control the fluid level.

Figure 18:
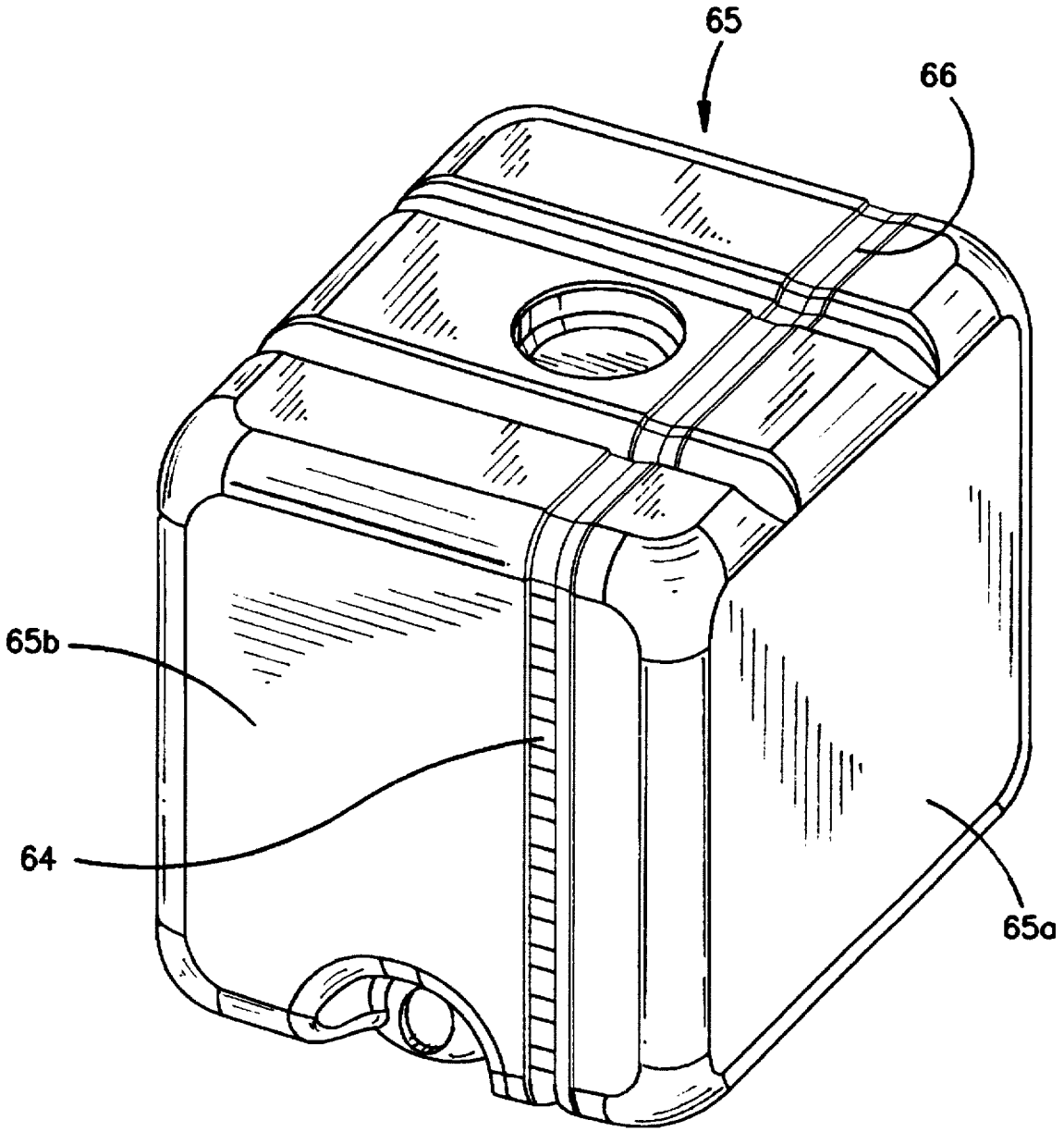

According to FIG. 18 the observation strip 64 has been installed in the seam 66 between the two halves 65*a*, 65*b* of the fluid container 65.

According to FIG. 19 the fluid container 69 for the pallet container 1 features lateral walls 69*a* 69*d* with integrated raised writing surfaces 70.

I claim:

1. In a pallet container which comprises a cube-shaped, blow molded fluid container made of plastic which has one sealable opening each for filling and emptying, and which has a drain bottom and a flexible inner liner made of a liquid-impervious foil, a pallet comprising a floor pan which has a drain bottom which serves as a form-fitted receptacle for the fluid container, as well as an outer shell which encloses the fluid container and which is constructed as a grid casing made of metal rods or as a sheet metal casing; the improvement wherein the exchangeable inner liner (4) is held in an opening (17) in the top (12, 13) of the fluid container (2, 33, 38, 43, 50, 55), wherein a downwardly pointing outer rim (44*a*) is integrally molded to an upper rim (44) of the fluid container (43) blow molded in one piece, and an upwardly pointing outer rim (45*a*) is integrally molded to a lower rim (45) of the top (13) of the container (43) leaving a space between rim joints (44*b*, 45*b*), and two outer rims (44*a*, 45*a*) which are connected by a ring-shaped bridge (46) which is thinner than the outer rims (44*a*, 45*a*), and a ring land (46) which is cut open at three walls (43*a*–43*c*) of the container (43) so that the top (13) of the container (43) is connected by a thin hinge (47) to the container shell (14) to form a hinged cover (48).

2. A pallet container according to claim 1, wherein the inner liner (4) has a dimensionally stable, flexible upper part (25) into which the filler neck (24) is integrally molded and which when inserted, rests against the top (12, 13) of the fluid container (2, 22, 38, 50, 55).

3. A pallet container according to claim 1, wherein the filler neck (24) of the inner liner (4) is held securely in the opening (17) of the top (12, 13) of the fluid container (2, 33, 38, 43, 50, 55) by a clamp collar (27) which locks into an undercut (28) of the filler neck (24).

4. A pallet container according to claim 1, wherein the fluid container (2, 33) has a removable closure (12*a*, 12*b*; 12*c*–12*e*).

5. A pallet container according to claim 1, wherein the shell (14) of the fluid container (38) has an opening rim (39) with a horizontal rim section (39*a*) and a rim section (39*b*) angled downward, and a removable lid (40) has a bottom rim (41) with a horizontal rim section (41*a*) which has been fitted to conform to the horizontal rim section (39*a*) and a rim section (41*b*) angled upward, the opening rim (39) in the shell and the cover rim (41) being clinched together by a clamp collar (42).

6. A pallet container according to claim 1, characterized by a sectioning (49, 51) of the fluid container (50) into two halves of equal size (50*a*, 50*a*; 50*b*, 50*b*).

7. A pallet container according to claim 1, characterized by a sectioning (49, 51) of the fluid container (50) into two halves of unequal size (50*c*, 50*d*; 50*e*, 50*f*).

8. A pallet container according to claim 1, characterized by a diagonal sectioning (52) of the fluid container (50) into two halves (50*g*) of equal size.

9. A pallet container according to claim 1, characterized by a diagonal sectioning (52) of the fluid container (50) into two halves of unequal size (50*h*, 50*i*).

10. A pallet container according to claim 1, wherein an opening rim (34) of the fluid container (33) extends up to the upper edge (35) of the grid casing (8) of the pallet container (1) over the container closure (12*c*–12*e*), and the container closure (12*c*–12*e*) comprises a clamp lid having a clamp rim (32) with a clamp profile (32*a*) by means of which the closure (12*c*–12*e*) is clamped to the inside (36) of the opening rim (34) of the container (33) which has a corresponding counter profile (34*a*) to the clamp profile (32*a*) of the cover rim (32).

11. A pallet container according to claim 10, characterized by water drain holes (37) in the opening rim (34) and/or in the clamp rim (32) of the closure (12*c*–12*e*).

12. A pallet container according to claim 1, wherein the closure (12*a*, 12*b*) of the fluid container (2) is a clamp lid with a clamp rim (32) which is used to clamp the closure (12*a*, 12*b*) onto the opening rim (11) of the fluid container (2) and which has a corresponding counter profile (11*a*) to the clamp profile (32*a*) of cover rim (32).

13. A pallet container according to claim 1, wherein an adhesive foil (56) protects against contamination and also serves as an original seal for a screw cap (30) of the fluid container (55).

14. A pallet container according to claim 1, further comprising observation holes (62) in at least one lateral wall (18) of the fluid container (2) to give a visible indication of the fluid level.

15. A pallet container according to claim 1, having an observation strip (64) made of transparent material, which is integrated into at least one lateral wall (63*a*) of the fluid container (63) in order to give a visible indication of the fluid level.

16. A pallet container according to claim 1, further comprising at least one observation strip (64) on a seam (66) between two halves 65*a*, 65*b*) of the fluid container (65).

17. A pallet container according to claim 1, further comprising an outlet shield (67) which is blow molded with the fluid container (2) with an arched recess (19) in a front wall (18) in a bottom area of the fluid container (2), and a bottom opening (21) for a drain nozzle (22) of the inner liner (4) to serve as a receptacle for a drain cock (23) which is connected to the drain nozzle (22), or which is blow molded onto the container (2) as a pre-manufactured injection molded part.

18. A pallet container according to claim 1, further comprising raised surfaces (70) for labeling which are integrally molded into at least one lateral wall (69*a*) of the fluid container (69).

19. In a pallet container which comprises a cube-shaped, blow molded fluid container made of plastic which has one sealable opening each for filling and emptying, and which has a drain bottom and a flexible inner liner made of a liquid-impervious foil, a pallet comprising a floor pan which has a drain bottom which serves as a form-fitted receptacle for the fluid container, as well as an outer shell which encloses the fluid container and which is constructed as a grid casing made of metal rods or as a sheet metal casing; the improvement wherein the exchangeable inner liner (4) is held in an opening (17) in the top (12, 13) of the fluid container (2, 33, 38, 43, 50, 55), wherein the inner liner (4) is held in top (12, 13) of the fluid container (2, 22, 38, 43, 50, 55) by a dimensionally stable filler neck (24) with an outside screw thread (29) onto which a screw cap (30) is placed, further comprising document holders (57, 58) which are installed on both sides of an opening (17) located in a channel (15) of the top (12, 13) of the fluid container (55) with the opening (17) for the filler neck (24) of the inner liner (4).

20. A pallet container according to claim 19, further comprising protective covers (59, 60) for the document holders (57, 58), which have been integrated into the top (12, 13) of the fluid container (55).

21. A pallet container according to claim 19, further comprising a protective lid (61) integrated into the top of the fluid container (2) to cover the screw cap (30) of the filler cap (24) and the document holders (57, 58).

22. A pallet container according to claim 21, having a dark tinting of the fluid container (2, 33, 38, 43, 50, 55) as protection against uv-rays.

* * * * *